US005542784A

United States Patent [19]

Gårdenberg

[11] Patent Number: 5,542,784

[45] Date of Patent: Aug. 6, 1996

[54] METHOD AND MEANS FOR DRIVING PIPES INTO THE GROUND AND CARTRIDGE USED THEREFOR AND FOR SUBSEQUENT PIPE BLASTING

[75] Inventor: Sture S. Gårdenberg, Järfälla, Sweden

[73] Assignee: Atlas Copco Berema Aktiebolag, Nacka, Sweden

[21] Appl. No.: 162,121

[22] PCT Filed: Jun. 12, 1993

[86] PCT No.: PCT/SE92/00412

§ 371 Date: Dec. 10, 1993

§ 102(e) Date: Dec. 10, 1993

[87] PCT Pub. No.: WO92/22727

PCT Pub. Date: Dec. 23, 1992

[30] Foreign Application Priority Data

Jun. 12, 1991 [SE] Sweden ..... 9101802

[51] Int. Cl.[6] ..... E02D 7/02

[52] U.S. Cl. ..... 405/232; 405/249; 37/905; 299/13

[58] Field of Search ..... 405/232, 249, 405/253, 255; 37/905; 299/13

[56] References Cited

U.S. PATENT DOCUMENTS

| | | | |
|---|---|---|---|
| 878,765 | 2/1908 | Braxton | 405/253 |
| 2,011,459 | 8/1935 | Snow et al. | 405/253 |
| 2,391,828 | 12/1945 | Hood | 405/232 X |
| 2,961,839 | 11/1960 | Aresti | 405/255 |
| 3,261,412 | 7/1966 | Lob . | |
| 4,487,129 | 12/1984 | Isaac | 299/13 X |
| 4,770,097 | 4/1988 | Wilson et al. | 299/13 X |
| 4,836,299 | 6/1989 | Bodine | 175/22 |
| 5,104,265 | 4/1992 | Halloran | 405/253 X |

FOREIGN PATENT DOCUMENTS

| | | | |
|---|---|---|---|
| 3328550 | 5/1984 | Germany | 299/13 |
| 94522 | 6/1983 | Japan | 405/249 |
| 94523 | 6/1983 | Japan | 405/249 |
| 57070 | 9/1936 | Norway . | |
| 901517 | 1/1982 | U.S.S.R. | 299/13 |
| 900666 | 2/1991 | U.S.S.R. | 299/13 |
| 1114935 | 5/1968 | United Kingdom | 405/232 |
| 2200673 | 8/1988 | United Kingdom . | |

*Primary Examiner*—Eric K. Nicholson
*Assistant Examiner*—John A. Ricci
*Attorney, Agent, or Firm*—Mark P. Stone

[57] ABSTRACT

When driving a tube (24) into the ground, primarily for subsequently loading the tube with an explosive substance and subsequent blasting of the surrounding ground, a driving rod (20) whose rear end is provided with an insert end (13) which can be connected to a percussion machine (36) is employed in the driving operation. The non-metallic tube (24) is fitted over the driving rod (20), against an axial stop (16). A forwardly located, conical sacrificial tip (28) has a base cross-section dimension (30) which corresponds to the outer dimension of the tube (24), followed by a neck portion providing a shoulder (31). The tip (28) is supported by the shoulder (31) with clamping engagement with the tube in an orifice of the tube, and forms, together with the tube (24), a unit (24, 28) which is fitted onto the driving rod (20) and brought into impact contact between an anvil surface (33) on the tip (28) and the forward end (21) of the device. The device (12), together with the tube (24), and the tip (28) mounted on the tube, penetrates the ground to a desired depth with the aid of a machine (36), and the device (12) is withdrawn leaving the tube (24) in the ground ready to be loaded with an explosive substance and blasted, or for some other use. The tube (24) can be used as a cartridge case for an explosive charge insert (24; 37), which can be removed from the tube prior to driving the tube into the ground.

15 Claims, 2 Drawing Sheets

METHOD AND MEANS FOR DRIVING PIPES INTO THE GROUND AND CARTRIDGE USED THEREFOR AND FOR SUBSEQUENT PIPE BLASTING

BACKGROUND OF THE INVENTION

The present invention relates to a method of driving tubes or pipes into the ground, and also to a tube driver for carrying out the method. The invention further relates to an explosive cartridge for use when carrying out the method and in the tube driving device, and also for loading the ground-entrenched tube with an explosive charge and subsequent blasting of the ground in the region surrounding said tube.

More specifically, the invention relates to a method of driving a tube into the ground with the aid of a driving rod whose length corresponds to the intended depth of the tube penetration, comprising the steps of fitting the tube around the driving rod, holding a generally conical, metallic sacrificial pointed tip, whose base cross-section dimensions contain the outer contour of the tube in impact contact with the forward end of the driving rod, driving the driving rod, together with tube and sacrificial tip into the ground to the depth intended, and withdrawing the driving rod away from the sacrificial tip and out of the ground-entrenched tube.

With regard to the tube driving device, the invention concerns a device for carrying out the method steps of driving a tube into the ground in accordance with the above and comprising a driving rod whose length corresponds to the intended ground penetrating depth of the tube, said tube being fitted around the driving rod, and at the forward end of which driving rod there is arranged a generally conical sacrificial pointed tip whose base cross-section dimensions contain the outer contour of the tube, said tip being intended to be driven into the ground together with the tube.

The inventive explosive cartridge is intended for use with the aforesaid tube driving method and the aforesaid tube driving device, and is also intended for loading the ground-entrenched tube with an explosive charge for subsequent blasting of the ground in the region of the entrenched tube.

Methods and devices for driving tubes and pipes into the ground are earlier known to the art from, for instance, Patent Specifications:

A. SE 46462
B. SE 46886
C. U.S. Pat. No. 2,902,832
D. U.S. Pat. No. 3,231,032
E. U.S. Pat. No. 3,370,659
F. U.S. Pat. No. 4,231,435
G. U.S. Pat. No. 3,261,412
H. U.S. Pat. No. 4,836,299

Publications A. and B. teach a method of placing an explosive charge in holes pre-drilled in the ground, and exploding the explosive charge to produce post erection holes. The task of placing an explosive charge in such holes is made difficult, because it is impossible to exclude the possibility that the hole will collapse. Publication C. teaches a method in which metal, road-embankment tubes are driven or speared into the ground, by hammering the rear ends of the tubes. This method is unsuitable for use with lightweight tubes and in conjunction with cautious or careful blasting operations. Publication D. teaches a method in which a metal, tubular liner is first driven into the ground, by striking or hammering the tube, whereafter a blasting tube is inserted in the liner and the liner then removed from the ground. This method requires the use of heavy equipment and is also time-consuming. This also applies to the teachings of Publication E., which teaches a method of rotating and hammering a metal tube into the ground and injecting an explosive charge thereinto. A ring-shaped drill bit is knocked-off adjacent the tube orifice and left in the ground, when the tube is withdrawn after use. Publication F. proposes, towards the end of the text, the use of a liner tube to prevent the collapse of holes which are formed in soft ground. The tube is fitted to a hole-forming tip and is driven into the ground together with the tip, by hammering the rear end of the tube with the aid of heavy percussion equipment, whereafter the tip is withdrawn from the liner tube. The large tube dimension required to accommodate the hole-forming tip means that the tube must be subjected to large hammering or impact forces, rendering the method unfavourable in the case of lightweight tubes, since the leading end of the tube is unprotected against the driving forces required. Publication G. evidently presumes the use of heavy pile-driving equipment, where the tube, which is withdrawn after use, rests loosely on a driving tip and accompanies the movement of said tip as the tip is driven into the ground. This ground contact is liable to prevent lightweight tubes from being driven into the ground. Publication H. teaches the application of acoustic resonance for driving into the ground a plastic tube fitted around a driving rod, said rod including an annular sacrificial tip which is less suited to receive impact forces.

SUMMARY OF THE INVENTION

The present invention relates to a tube-driving method which is an improvement on and simpler to carry out than earlier known tube-driving methods, said tubes being primarily intended for subsequent blasting of the ground in a manner which, with the aid of light equipment, will enable hollows and pits to be created in hard ground, shale, such as stony ground, frozen ground, permafrost, loose limestone and compacted sand, i.e. ground which cannot be dug or excavated readily by hand or by machine. The invention is also intended to enable plastic pipes or tubes of small dimensions to be driven manually into the ground, the dimensions of said pipes or tubes being particularly suitable to enable the surrounding hard ground to be blasted and therewith loosened, so that the area blasted can be readily excavated to provide the desired hollow configuration. The invention can be applied to particular advantage for military use, since it will enable the ground to be blasted and subsequently excavated with the aid of hand-held equipment such as to form protective hollows, e.g. foxholes, for the protective coverage of one or two men. The invention can also be applied to drive into the ground lightweight tubes or pipes for water sampling purposes and also for the erection of posts. These aims of the present invention are achieved by the method and apparatus set forth in the characterizing clauses of the respective method and apparatus claims appended hereto.

BRIEF DESCRIPTION OF THE DRAWINGS

The invention will now be described in more detail with reference to the accompanying drawings.

DESCRIPTION OF THE BEST MODES FOR CARRYING OUT THE INVENTION

Figure 1:
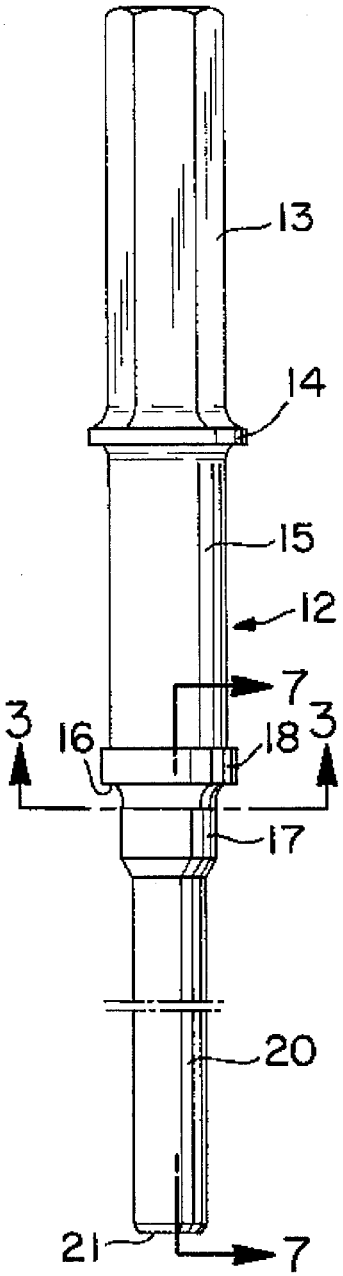
FIG. 1 of the drawings is a side view of a shortened inventive tube-driving device.
Figure 3:
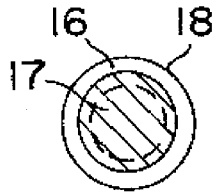
FIG. 3 is a cross-sectional view taken on the line 3—3 in FIG. 1.
Figure 8:
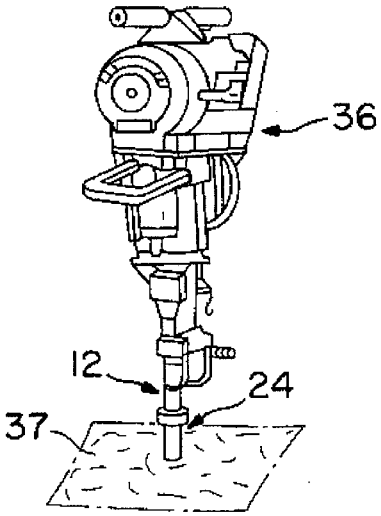
FIG. 8 is a pictorial view in perspective of a hand-held mechanical driver and shows the device, the tube and the sacrificial tip driven to full depth in the ground, by means of the driver.

Shown in FIG. 1 is a device or tool 12 comprising a rear insertion-end 13 which is provided with a collar 14 and which is intended to be fitted to a mechanical hammer 36, preferably a hand-held mechanical hammer such as the kind illustrated in FIG. 8, which Figure illustrates an internal-combustion-engine driven machine which is used to both pierce and to drill the ground and which is sold by Atlas Copco Berema AB, Nacka, Sweden, under the trade name PIONJÄR. This machine functions to hammer and rotate the device when drilling a hole and can be adjusted solely to a percussion or an impact mode for driving the device into the ground. The device includes forwardly of the collar 14 a short intermediate part 15 which merges with a narrower part in the form of an elongated driving rod 20, via a forward collar 18, an axial abutment surface 16 and a guide 17. The drive rod 20 preferably has a circular cross-section and presents a front surface 21.

Figure 4:
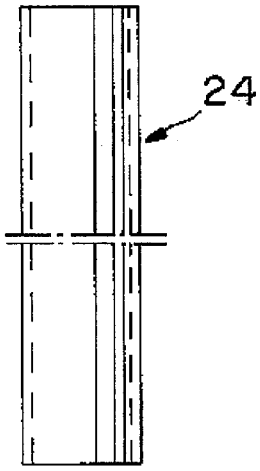
FIG. 4 is a side view of a shortened tube to be driven into the ground.
Figure 5:
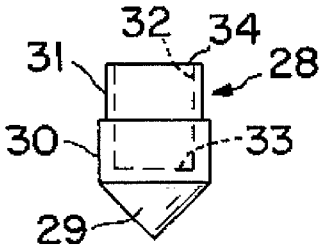
FIG. 5 is a side view of a sacrificial tip for use in a tube-driving operation.
Figure 2:
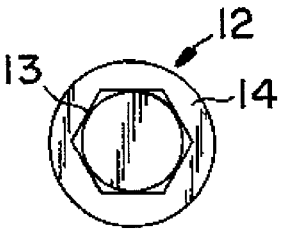
FIG. 2 is a rear end-view of the device.
Figure 6:
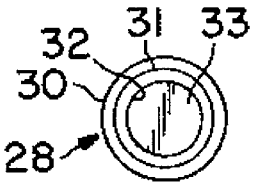
FIG. 6 is a rear end-view of the sacrificial tip shown in FIG. 5.

The tube 24 shown in FIG. 4 is a lightweight tube, preferably a plastic tube made of PVC, which is suited for blasting purposes and which is designated commercially as a VP tube. The tube has an inner diameter which will enable the tube to be fitted freely around the rod 20. The sacrificial tip 28 illustrated in FIG. 5 is a solid steel body which has a conical point 29 and a conical base 30 whose cross-sectional dimension is preferably equal to the outer diameter of the tube 24, but which can be given a greater cross-sectional dimension when necessary. The conical base 30 forms a cylinder which merges with a cylindrical reduced or necked rear-part 31 with which the sacrificial point 28, preferably with clamping engagement, can be inserted into one end of the tube 24, or alternatively glued to the tube or fastened thereto in some other way, thereby to obtain a readily-handled unit 24, 28 comprised of the sacrificial tip and the tube. The rear part 31 of the sacrificial tip 28 is provided with a recess 32 whose cross-section is somewhat greater than the cross-section of the driving rod 20, and a bottom surface, or anvil surface 33, normally a circular surface, which can be positioned so as to coincide with the front or leading surface 21 of the driving rod.

Figure 7:
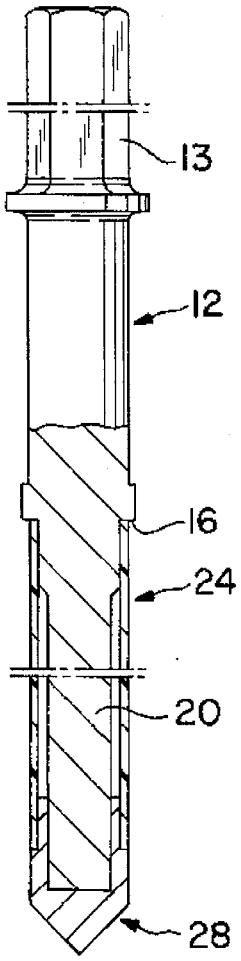
FIG. 7 is a side view of the device shown in FIG. 1 and also a partially sectioned view taken on the line 7—7 in FIG. 1, and shows the device fitted with a tube and a sacrificial tip in accordance with FIGS. 4 and 5, so as to be ready for insertion into the ground.

When driving the device into the ground, the sacrificial tip 28 is clamped in the forward end of the tube 24 and forms a unit 24, 28 therewith. The tube 24 of the unit 24, 28 is fitted manually onto the driving rod 20, over the guide 17, and brought into abutment with the axial abutment surface 16, with the inner surface 33 of the sacrificial point 28 lying against the front surface 21 of the driving rod 20. The tube 24 is held in this position by its engagement with the guide 17. This is illustrated in FIG. 7. The insert end 13 of the device 12, with the tube 24 seated thereon, is then inserted into the mechanical tool 36, with the sacrificial tip 28 resting against the point at which the device is to be driven into the ground, and the device is hammered, without being rotated, down to a depth determined by the chosen length of the tube and the driving rod, FIG. 8. The tube 24 is supported by the axial abutment 16 and follows the sacrificial tip 28 into the ground, the cross-sectional dimensions 30 of the sacrificial tip forming a free passageway for the tube 24. As the hammer blows are delivered to the driving rod 20, the clamping force acting on the rear part 31 and the frictional forces acting on the guide 17 assist in downward driving of the device and also provide a certain degree of movement between the sacrificial tip 28 and the tube 24, so that no impact forces or tensile strains of a magnitude harmful to the tube will, under normal conditions, be transmitted to the tube. When the tube 24 has been driven into the ground to the extent desired, the driving rod 20 is withdrawn and the tube 24 and the sacrificial tip 28 are left in the ground for subsequent use, preferably in the performance of a blasting operation.

The described method can be applied effectively and advantageously in hard ground that cannot be dug, particularly when the impact power of the hand-held mechanical tool is sufficient to enable the driving rod 20 to be driven directly into the ground. In the case of extremely hard ground, in stony ground, permafrost and ground that is composed of harder limestone, the machine can be used to first drill a hole in the ground and then to drive the tube, without rotating the same, into the pre-drilled hole as before described, with sufficient congestion to obtain good ground contact and while displacing collapsed material in the hole. The diameter of the drilled hole should be such as to cause the sacrificial tip 28 to meet a given resistance when driving the tip into the ground so that the tip will remain seated in the tube 24 upon impact.

When necessary, the tube 24 and the sacrificial tip 28 may be driven into the ground with the aid of a rotating device 12. In this case, the sacrificial tip 28 may be provided with means which will prevent it from rotating, for example means in the form of lateral wings (not shown) provided at the conical point 29, so that the sacrificial tip 28 and the tube 24 will penetrate the ground without being forcibly rotated by the rotating driving rod 20. It will be apparent that, when necessary, a tube 24 of non-circular cross-section can be used with consequential adaptation of the cross-sectional shape of the sacrificial tip 28 and the driving rod 20.

When the charge is calculated correctly, blasting in ground suited for spear-like penetration of the device or tool 12 will result only in an insignificant upthrow of ground debris and the normally non-diggable ground around the site of the explosion is broken-up or finely-divided by the impact waves thus generated, thereby enabling the ground to be readily excavated or shovelled-out to form a hollow or pit with essentially straight vertical walls. When required, this work can also be carried out with the assistance of the afore-described hand-held mechanical percussion tool. The method can be applied to create hollows, pits and holes for many different purposes, for instance for the erection of posts and walls, and for anchorage and drainage purposes.

Tests have been carried out in blasting and subsequently digging a series of one-man and two-man foxholes in fine-aggregate and highly stony moraine, or boulder clay, frozen to a depth of about 60 cm and at an ambient temperature of between −22° to −27° C. The best result was obtained with the use of VP tubes that had an inner and an outer diameter of 28 and 32 mm respectively. These tubes could be driven, or speared, into the ground down to a depth of about 110 mm in the space of six minutes, with the aid of the aforesaid PIONJÄR machine, although in order to expedite the driving operation, the same machine was used to pre-drill holes of 34 mm in diameter. Each hole took one minute to drill. It took the same length of time to complete a tube driving operation using the same machine. In the case of two-man foxholes, two vertical holes were drilled at a mutual distance of 700 mm apart, partially into the frozen ground to a depth of 350 mm. A 28/32 mm PVC tube was driven down into each hole, to a depth of 1200 mm. Each tube was then loaded with 0.5 kg of an explosive retailed under the trade name Kimulux 82, whereafter the tube was filled with damping sand and then exploded. After digging and shovelling away loosened debris for about ten minutes, there was obtained a foxhole which had straight walls, a cross-sectional area corresponding to 700×500 mm, and a depth of 1100 mm. The total time taken to produce the foxhole, in non-diggable ground, was 15–20 minutes. Experience has shown that it is best to use 0.35–0.5 kg explosive when creating a foxhole to a depth equal to 60–80% of the average standing height of a person. A large volume of gas should be generated when the explosive is detonated and the explosive should have a detonation rate of 4500–5000 m/sec.

Figure 9:
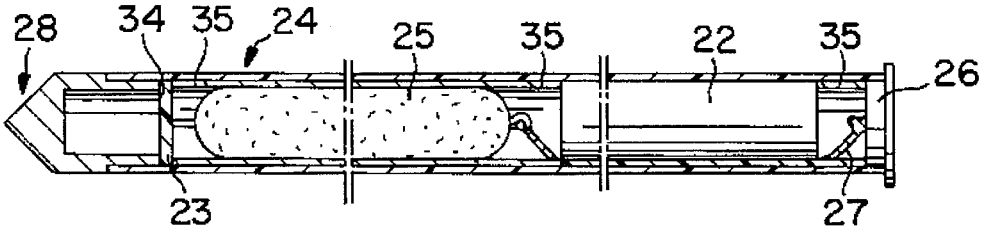
FIG. 9 illustrates the use of the tube and the sacrificial tip as a cartridge and casing for a removable explosive charge. Finally.

When needing to quickly prepare for the blasting of a large number of holes for the purpose of providing shafts or fortifications and retrenchments in non-diggable ground, an important advantage is gained by using the aforesaid unit, comprised of the tube 24 and the sacrificial tip 28 as a cartridge or as a casing for transportation of the explosive charge 25, FIG. 9. A circular end-plate 23 supports against the rear end surface 34 of the sacrificial tip 28, the explosive charge 25, conveniently comprised of a single rod or a multi-rod pack and was inserted into abutment with the circular end-plate 23 in the tube 24, with a charge withdrawal line 27 connected to a rear tube-cap 26. The cord 27 passes along one side of a damping or stemming package 22, which contains non-freezable (dried) sand. As illustrated, spacing sleeves 35 may be inserted between the components 23, 25, 22, 26 in the tube 24, so as to hold these components in position in the cartridge.

When wishing to use the inventive device, the damping pack 22 and the explosive charge 25 are first withdrawn from the tube 24 and the device is then driven into the ground together with the sacrificial tip 28, as before described. The explosive charge 25 is then reinserted into the now ground-entrenched tube, subsequent to having connected a detonator and fuse wire to the charge in a conventional manner, whereafter the damping pack 22 is broken open and its sand content poured into the tube 24 and compacted therein to form a stemming. Blasting can then take place.

Figure 10:
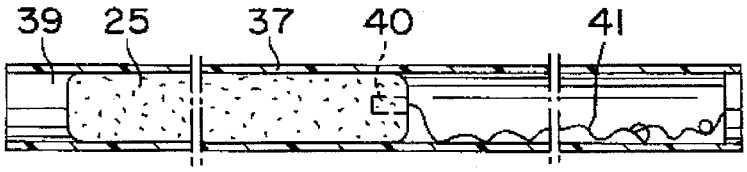
FIG. 10 illustrates an inner cartridge-casing intended as an alternative to the cartridge casing shown in FIG. 9.

Handling of the device can be improved when the unit comprised of the sacrificial tip 28 and the explosive charge 25 carries the charge 25 in an inner casing 37 together with a detonator 40 and part of the fuse wire 41 connected thereto. The inner casing 37 has the form of a plastic tube, FIG. 10, which can be inserted into the tube 24. In use, and prior to commencing a tube driving operation, the inner casing 37 can be withdrawn from the tube and then reinserted into the tube upon completion of a driving operation. When loading the device, the plastic plug 39 is brought into contact with the rear-end 34 of the tip 28. The sacrificial tip 28 may be hot immediately after being subjected to driving impact. Consequently, a heat-protective plastic plug 39 is conveniently provided forwardly in the inner casing 37. The charge 25 lies behind the plug 39 and the rear end of the charge carries the detonator 40, which is connected to a partially withdrawable fuse wire 41 suitably closely confined in the tube in a helical fashion. Subsequent to withdrawing and extending the fuse wire, the separately carried stemming or damping sand is poured into the tube and the fuse wire 41 is connected to the detonating system (not shown), whereafter blasting can be commenced.

When the tube 24 is to be used to check and monitor the contamination of ground water, the tube 24 may be provided with appropriate perforations. The impaled tube 24 may also be used as an anchorage hole for posts and temporary signs. In seismic investigations, blasting of ground tubes 24 creates improved safety in the generation of detonation pulses.

I claim:

1. A method of driving a tube in the ground with the aid of a driving rod (20) whose length corresponds to the intended penetration depth of the tube (24), the steps of said method comprising placing the tube (24) around the driving rod (20), maintaining in impact contact with the forward end of the driving rod (20), a generally conical metallic sacrificial tip (28), whose base cross section (30) contains the outer contour of the tube (24) and provided with an anvil surface (33) which extends over the major part of the base cross-section (at 30), driving the driving rod (20), the tube (24) and the sacrificial tip (28) into the ground to the intended penetration depth, and withdrawing the driving rod (20) from the sacrificial tip and out of the ground-entrenched tube, characterized by using in said driving operation a non-metallic plastic tube (24) and a solid sacrificial tip (28) closing one end of the tube (24) with the sacrificial tip (28) so that the anvil surface (33) forms the bottom of the unit (24, 28) formed by the thus united sacrificial tip and tube, manually fitting the tube (24) onto the driving rod (20) into holding engagement (at 17) therewith by fitting the tube around a guide (17) on said driving rod and against an axial stop (16) provided thereon so as to hold the anvil surface (33) of the unit (24, 28) against the front end (21) of the driving rod (20) in an impact position, for the purpose of driving the unit (24, 28) into the ground, manually applying the driving rod (20) with the unit (24, 28) thereon against the point at which driving is to be performed, and hammering the driving rod (20) down to a predetermined penetration depth by a hand held hammer machine.

2. A method according to claim 1, characterized by, when the ground is hard, drilling a ground hole of generally the same diameter as the tube (24) to a desired ground penetrating depth prior to a driving operation, and then driving the tube into the ground through the pre-drilled hole while offering, by the ground defining the hole, resistance to the tip (28) so that it will remain in unit with said tube (24) upon impact.

3. A method according to claim 2, further including the steps of loading the ground-entrenched tube (24) with an explosive charge and exploding the tube (24) in a manner to loosen the surrounding, hard ground so as to enable said ground to be dug.

4. A method according to claim 1, further including the steps of loading the ground-entrenched tube (24) with an explosive charge and exploding the tube (24) in a manner to loosen the surrounding, hard ground so as to enable said ground to be dug.

5. The method as claimed in claim 4 including the steps of driving said tube (24) having an inner and and outer diameter of 28/32 mm respectively, vertically into the ground to a penetration depth in the order of 60–80% of an average standing height of a person, and then loading the tube in the ground with 0.35–0.5 kg of explosive substance and exploding said substance.

6. A method according to claim 5 as applied in conjunction with blasting and subsequent excavation of two-man foxholes for military use, characterized by driving vertically into the ground two tubes (24) mutually spaced at a distance of 500–800 mm and each having an inner/outer diameter of 28/32 mm respectively, said tubes being driven to a depth in the order of 60–80% of an average standing height, of a person whereafter each of the tubes in the ground is loaded with 0.35–0.5 kg of an explosive substance and said explosive substances are exploded simultaneously.

7. A method according to claim 1, characterized by the step of centering the sacrificial tip (28) in detachable clamping engagement with an orifice defined in said one end of the tube (24) closed with said sacrificial tip of said unit (24, 28) at a location behind said base cross-section (at 30), for securing the sacrificial tip (28) to the tube (24).

8. A tube driving device for driving a non-metallic plastic tube into the ground, said tube driving device comprising a driving rod (20) whose length corresponds to the intended depth of penetration of a tube (24), wherein the tube (24) is placed around the driving rod (20), and further comprising a generally conical sacrificial tip (28) which extends from a forward end of the tube (24) and which has a base cross-section (at 30) which includes the outer contour of the tube (24) and is for driving into the ground together with said tube (24), the sacrificial tip (28) forming a metallic anvil means having an impact-receiving anvil surface (33) which extends over the major part of the base cross-section (at 30), characterized in that the driving rod (20) forms the forward end of a machine driven breaker tool (12) which has a rear insert end (13) adapted for insertion into a hand-held percussive machine (36) and for receiving impacts from said machine, and a forward impact delivering end (21), in that the tube to be driven into the ground is held on the solid sacrificial tip (28) to form a unit therewith, wherein the anvil surface (33) forms the bottom of the unit (24, 28), and in that prior to driving the tube into the ground, the unit (24, 28) is adapted to be fitted manually onto the driving rod (20), said driving rod (20) being provided forwardly of the insert end (13) with guide means (17) and an axial stop (16) for tube (24) which function to retain the unit (24, 28), wherein the tube (24) is adapted to engage (at 17) the driving rod (20) so as to hold the anvil surface (33) against the impact delivering end (21) of the driving rod (20), and wherein the driving rod (20) with the unit (24, 28) thereon is adapted to be manually applied against the point where driving is to be performed so that the driving rod can be hammered down to a predetermined depth by said percussive machine (36).

9. A device according to claim 8, characterized in that the sacrificial tip (28) with a rear recess (32) encircles the impact-delivering end (21) of the driving rod (20) in impact contact therewith via the anvil surface (33) at the bottom of the recess (32).

10. A method of driving a tube in the ground with the aid of a driving rod (20) whose length corresponds to the intended penetration depth of the tube (24), the steps of said method comprising placing the tube (24) around the driving rod (20), maintaining in impact contact with the forward end of the driving rod (20), a generally conical metallic sacrificial tip (28), whose base cross section (30) contains the outer contour of the tube (24) and provided with an anvil surface (33) which extends over the major part of the base cross-section (at 30), driving the driving rod (20), the tube (24) and the sacrificial tip (28) into the ground to the intended penetration depth, and withdrawing the driving rod (20) from the sacrificial tip and out of the ground-entrenched tube, characterized by using in said driving operation a non-metallic plastic tube (24) and a solid sacrificial tip (28) closing one end of the tube (24) with the sacrificial tip (28) so that the anvil surface (33) forms the bottom of the unit (24, 28) formed by the thus united sacrificial tip and tube, manually fitting the tube (24) onto the driving rod (20) into holding engagement (at 17) therewith as to hold the anvil surface (33) of the unit (24, 28) against the front end (21) of the driving rod (20) in an impact position, for the purpose of driving the unit (24, 28) into the ground, and fixating the position of the tube (24) by fitting the tube around a guide (17) on the driving rod (20) and against an axial stop (16) provided thereon.

11. A method according to claim 10, characterized by the step of centering the sacrificial tip (28) in detachable clamping engagement with an orifice defined in said one end of the tube (24) closed with said sacrificial tip of said unit (24, 28) at a location behind said base cross-section (at 30) for securing the sacrificial tip (28) to the tube (24).

12. A tube driving device for driving a non-metallic plastic tube into the ground, said tube driving device comprising a driving rod (20) whose length corresponds to the intended depth of penetration of a tube (24), wherein the tube (24) is placed around the driving rod (20), and further comprising a generally conical sacrificial tip (28) which extends from a forward end of the tube (24) and which has a base cross-section (at 30) which includes the outer contour of the tube (24) and is for driving into the ground together with said tube (24), the sacrificial tip (28) forming a metallic anvil means having an impact-receiving anvil surface (33) which extends over the major part of the base cross-section (at 30), characterized in that the driving rod (20) forms the forward end of a machine driven breaker tool (12) which has a rear insert end (13) adapted for insertion into a percussive machine (36) and for receiving impacts from said machine, and a forward impact delivering end (21), in that the tube to be driven into the ground is held on the solid sacrificial tip (28) to form a unit therewith, wherein the anvil surface (33) forms the bottom of the unit (24, 28), and in that prior to driving the tube into the ground, the unit (24, 28) is adapted to be fitted manually onto the driving rod (20), wherein the tube (24) is adapted to engage (at 17) the driving rod (20) so as to hold the anvil surface (33) against the impact delivering end (21) of the driving rod (20), and said driving rod (20) being provided forwardly of the insert end (13) with guide means (17) and an axial stop (16) for the tube (24) which function to retain the unit (24, 28).

13. A tube driving device for driving a non-metallic plastic tube into the ground, said tube driving device comprising a driving rod (20) whose length corresponds to the intended depth of penetration of a tube (24), wherein the tube (24) is placed around the driving rod 20, and further comprising a generally conical sacrificial tip (28) which extends from a forward end of the tube (24) and which has a base cross-section (at 30) which includes the outer contour of the tube (24) and is for driving into the ground together with said tube (24), the sacrificial tip (28) forming a metallic anvil means having an impact-receiving anvil surface (33) which extends over the major part of the base cross-section (at 30), characterized in that the driving rod (20) forms the forward end of a machine driven breaker tool (12) which has a rear insert end (13) adapted for insertion into a percussive machine (36) and for receiving impacts from said machine, and a forward impact delivering end (21), in that the tube to be driven into the ground is held on the solid sacrificial tip (28) to form a unit therewith, wherein the anvil surface (33) forms the bottom of the unit (24, 28), and in that prior to driving the tube into the ground, the unit (24, 28) is adapted to be fitted manually onto the driving rod (20), wherein the tube (24) is adapted to engage (at 17) the driving rod (20) so as to hold the anvil surface. (33) against the impact delivering end (21) of the driving rod (20), and an orifice defined centrally at said forward end of the tube (24) and in detachable clamping engagement with a shoulder (31) formed on the rear part of the sacrificial tip (28), said shoulder (31) being of reduced cross-section in relation to the base cross-section (at 30) of said tip.

14. A tube driving device for driving a non-metallic plastic tube into the ground, said tube driving device comprising a driving rod (20) whose length corresponds to the intended depth of penetration of a tube (24), wherein the tube (24) is placed around the driving rod (20), and further comprising a generally conical sacrificial tip (28) which extends from a forward end of the tube (24) and which has a base cross-section (at 30) which includes the outer contour of the tube (24) and is for driving into the ground together with said tube (24), the sacrificial tip (28) forming a metallic anvil means having an impact-receiving anvil surface (33) which extends over the major part of the base cross-section (at 30), characterized in that the driving rod (20) forms the forward end of a machine driven breaker tool (12) which has a rear insert end (13) adapted for insertion into a hand-held percussive machine (36) and for receiving impacts from said machine, and a forward impact delivering end (21), in that the tube to be driven into the ground is held on the solid sacrificial tip (28) to form a unit therewith, wherein the anvil surface (33) forms the bottom of the unit (24, 28), and in that prior to driving the tube into the ground, the unit (24, 28) is adapted to be fitted manually onto the driving rod (20), wherein the tube (24) is adapted to engage (at 17) the driving rod (20) so as to hold the anvil surface (33) against the impact delivering end (21) of the driving rod (20), and wherein the driving (20) with the unit (24, 28) thereon is adapted to be manually applied against the point where driving is to be performed so that the driving rod can be hammered down to a predetermined depth by said percussive machine (36), said forward end of said tube (24) defining an orifice which lies centrally and in detachable clamping engagement with a shoulder (31) formed on the rear part of the sacrificial tip (28), said shoulder being of reduced cross-section in relation to the base cross-section (at 30) of said tip.

15. A device according to claim 14 characterized in that the sacrificial tip (28) with a rear recess (32) encircles the impact-delivering end (21) of the driving rod (20) in impact contact therewith via the anvil surface (33) at the bottom of the recess (32).

* * * * *

UNITED STATES PATENT AND TRADEMARK OFFICE

CERTIFICATE OF CORRECTION

PATENT NO. : 5,542,784

DATED : August 6, 1996

INVENTOR(S) : Sture S. Gardenberg

It is certified that error appears in the above-identified patent and that said Letters Patent is hereby corrected as shown below:

On title page, item [22] : Delete "PCT Filed: Jun 12, 1993", and

Substitute - -PCT Filed: Jun. 12, 1992- -

Signed and Sealed this

Twelfth Day of November, 1996

*Attest:*

*Attesting Officer*

BRUCE LEHMAN

*Commissioner of Patents and Trademarks*